US009548532B2

(12) United States Patent
Chiang

(10) Patent No.: US 9,548,532 B2
(45) Date of Patent: Jan. 17, 2017

(54) ANTENNA APPARATUS HAVING SENSING COMPONENT COUPLED TO FIRST ANTENNA COMPONENT TO ADDITIONALLY ACT AS SECOND ANTENNA COMPONENT AND RELATED SIGNAL PROCESSING DEVICE

(75) Inventor: Hung-Chung Chiang, Taipei (TW)

(73) Assignee: JIENG TAI INTERNATIONAL ELECTRIC CORP., New Taipei (TW)

( * ) Notice: Subject to any disclaimer, the term of this patent is extended or adjusted under 35 U.S.C. 154(b) by 384 days.

(21) Appl. No.: 13/563,757

(22) Filed: Aug. 1, 2012

(65) Prior Publication Data

US 2013/0033400 A1 Feb. 7, 2013

(30) Foreign Application Priority Data

Aug. 2, 2011 (TW) ..... 100127394 A
Jul. 31, 2012 (TW) ..... 101127593 A

(51) Int. Cl.
*H01Q 21/30* (2006.01)
*H01Q 9/04* (2006.01)
*H01Q 1/44* (2006.01)

(52) U.S. Cl.
CPC ..... *H01Q 1/44* (2013.01); *H01Q 21/30* (2013.01)

(58) Field of Classification Search
CPC ..... H01Q 21/30; H01Q 1/44; H01Q 9/04; H03K 17/955; H03K 2017/945
See application file for complete search history.

(56) References Cited

U.S. PATENT DOCUMENTS

2002/0094789 A1* 7/2002 Harano ..... 455/90
2003/0064761 A1* 4/2003 Nevermann ..... 455/572
2004/0248523 A1* 12/2004 Nishimura ..... H01Q 1/245 455/78
2008/0246679 A1* 10/2008 Martek et al. ..... 343/793
2011/0250928 A1* 10/2011 Schlub ..... H01Q 1/243 455/550.1
2013/0029625 A1* 1/2013 Park et al. ..... 455/272
2014/0306857 A1* 10/2014 Bevelacqua ..... H01Q 1/243 343/750

FOREIGN PATENT DOCUMENTS

JP 2003209483 A 7/2003
KR 1020090076630 A 7/2009

* cited by examiner

*Primary Examiner* — Hoang V Nguyen
(74) *Attorney, Agent, or Firm* — CKC & Partners Co., Ltd.

(57) ABSTRACT

An antenna apparatus includes a first antenna component and a first sensing component. The first antenna component has at least one first mode. The sensing component is a front-end component of a sensing device, wherein the sensing component is further coupled to the first antenna component to act as a second antenna component having a second mode.

9 Claims, 5 Drawing Sheets

ANTENNA APPARATUS HAVING SENSING COMPONENT COUPLED TO FIRST ANTENNA COMPONENT TO ADDITIONALLY ACT AS SECOND ANTENNA COMPONENT AND RELATED SIGNAL PROCESSING DEVICE

BACKGROUND OF THE INVENTION

1. Field of the Invention

The disclosed embodiments of the present invention relate to an antenna design, and more particularly, to an antenna apparatus having a sensing component coupled to a first antenna component to additionally act as a second antenna component and a related signal processing device.

2. Description of the Prior Art

Along with advance of communication technology, mobile communication devices are more and more popular. However, electromagnetic radiation generated by a mobile communication device will cause harm to the human body, and therefore present wireless communication specifications have strict regulations about a specific absorption rate (SAR) generated by an antenna.

A traditional SAR control method is employing a sensor to sense whether there is an approaching human tissue and accordingly regulating the electromagnetic radiation generated by the antenna to make it fall within an acceptable range, wherein the sensor is often kept in a distance from the clearance zone of the antenna to prevent the efficiency of the antenna from degrading. However, such a design would need extra space for deploying the sensor and the clearance zone, and such space available for the sensor is getting smaller while the mobile communication device becomes more compact.

Besides, the maximum value of the SAR happens in the radiation zone of the antenna. If the sensor is distanced from the antenna too far, a user may be exposed to the hazardous electromagnetic radiation. Therefore, there is a need to provide a monolithic design for integration of the antenna and the sensor, such that the sensor can sense the SAR more effectively.

SUMMARY OF THE INVENTION

In accordance with exemplary embodiments of the present invention, an antenna apparatus having a sensing component coupled to a first antenna component to additionally act as a second antenna component and a related signal processing device are proposed to solve the above-mentioned problem.

According to a first aspect of the present invention, an exemplary antenna apparatus is disclosed. The antenna apparatus includes a first antenna component and a first sensing component. The first antenna component has at least one first mode. The first sensing component is a front-end component of a sensing device, wherein the sensing component is further coupled to the first antenna component to act as a second antenna component having a second mode.

According to a second aspect of the present invention, an exemplary signal processing device is disclosed. The signal processing device includes a first antenna component and a sensing device. The first antenna component has at least one first mode. The sensing device includes a sensing component and a control circuit. The sensing component is used for generating a sensing signal, wherein the sensing component is further coupled to the first antenna component to act as a second antenna component having a second mode for receiving a wireless signal; The control circuit is coupled to the first antenna component and the sensing component, and used for generating a control signal according to the sensing signal generated from the sensing component, to control output power of the first antenna component.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to.". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
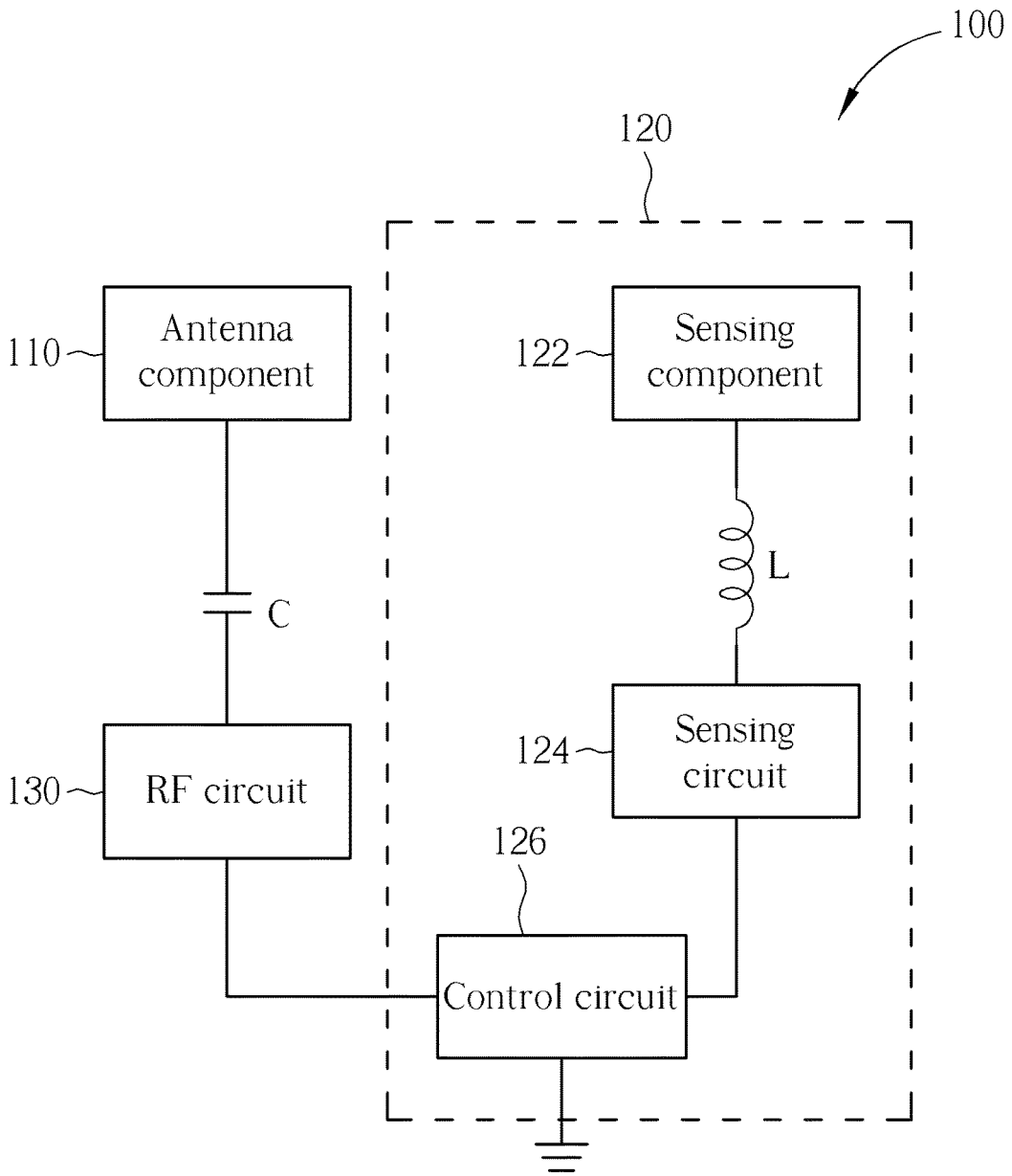
FIG. 1 is a schematic diagram of an antenna apparatus according to a first embodiment of the present invention.

Please refer to FIG. 1, which is a schematic diagram of an antenna apparatus according to a first embodiment of the present invention. In the embodiment, the antenna apparatus 100 includes, but not limited to, an antenna component 110, a sensing device 120 and a RF circuit 130. The antenna apparatus 100 may be disposed on a handheld electronic device (e.g., a tablet). However, it is not meant to be limitations of the present invention, and in practice, any implementations employing the antenna apparatus 100 disclosed by the present invention should fall in the scope of the present invention. The antenna component 110 is coupled to the RF circuit 130 via a capacitor C, and has at least one frequency resonance mode (e.g., GSM850/900/1800/1900). In addition, the sensing device 120 is utilized for detecting whether a human body approaches, and includes, but not limited to, a sensing component 122 and a control circuit 126. The sensing component 122 may be a circuit disposed on a flexible print circuit (FPC) and act as a front-end component of the sensing device 120; besides, the sensing component 122 may be disposed in a clearance zone of the antenna component 110, for generating a sensing signal SA to indicate whether a human body approaches. The sensing circuit 124 is coupled to the sensing component 122 via an inductor L, and arranged for processing sensing signal SA to generate a processed sensing signal SA'. In addition, the control circuit 126 is coupled to the RF circuit 130 and the sensing component 122, and used for generating a control signal SC according to the sensing signal SA to control output power of the antenna component 110. Moreover, in the embodiment, with a proper configuration (e.g., the capacitor C and inductor L), the antenna component 110 may act as a sensing component of the sensing device 120 while the sensing device 120 is active. Moreover, the sensing component 122 is further coupled with the antenna component 110 to act as a second antenna component, and has a second mode (e.g., WCDMA BAND1 2100) to receive a wireless communication signal.

In detail, in order to make the sensing component 122 be coupled with the antenna component 110, impedance viewed by the sensing component 122 looking into the control circuit 126 has to be low (e.g., zero or near zero). In this way, the sensing component 122 may be coupled to ground through the control circuit 126, without affecting working band of the second mode.

In addition, in order to prevent the sensing component 122 from affecting the efficiency of the antenna component 110, the antenna apparatus 100 may avoid introducing interference to the frequency band in use by changing a triggering clock of the control circuit 126. For example, when the triggering clock is configured to having the frequency of 1 KHz, interference introduced to the GSM850/900 frequency band is effectively diminished. Note that, the above-mentioned design for mitigating interference is for illustrative purposes only, and not meant to be limitations of the present invention. Without departing from the spirit of the present invention, other implementations employed by those skilled in the art should fall in the scope of the present invention.

Figure 2:
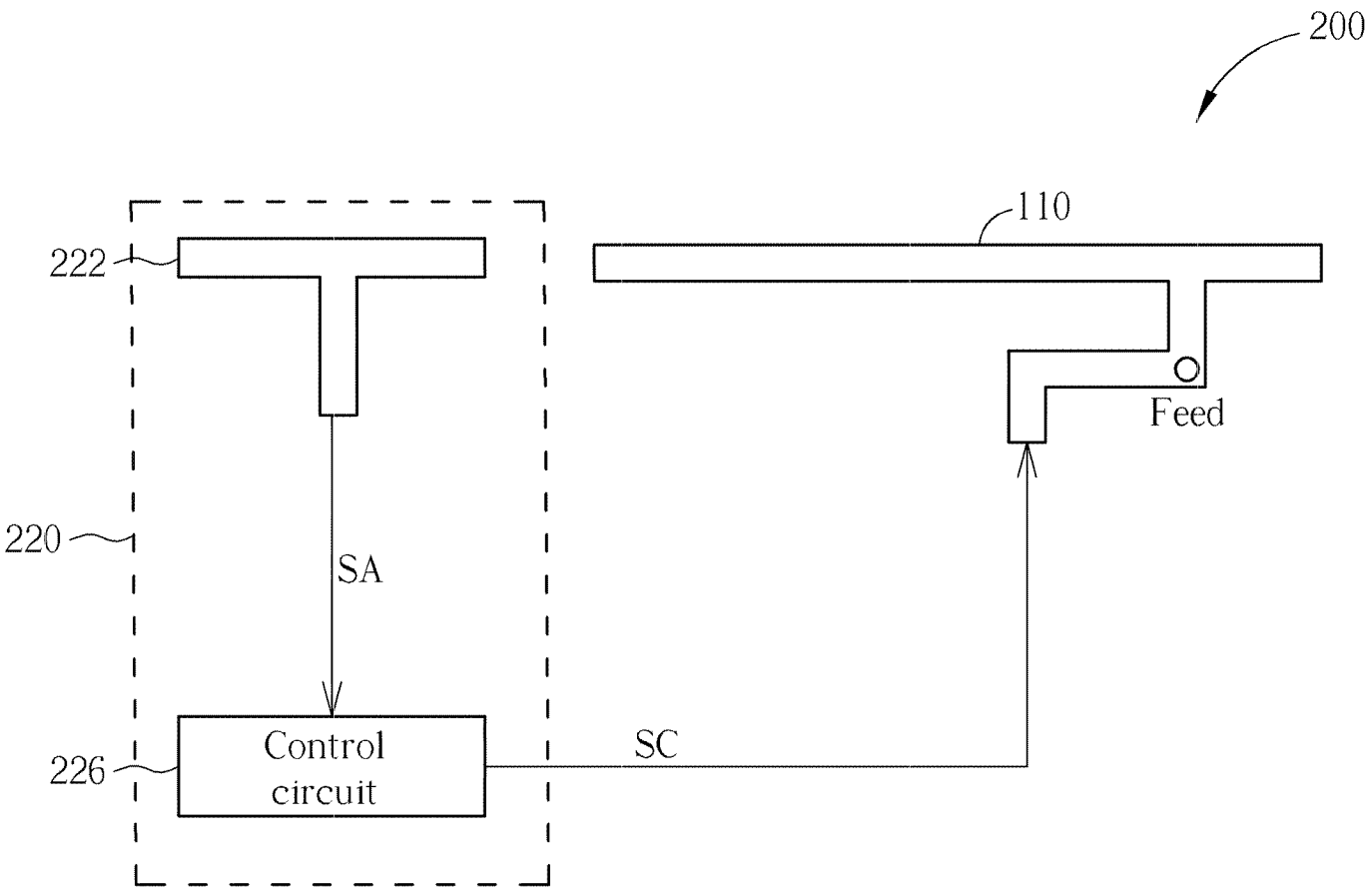
FIG. 2 is a schematic diagram of a configuration of an antenna component and a sensing component of an antenna apparatus according to a first embodiment of the present invention.
Figure 3:
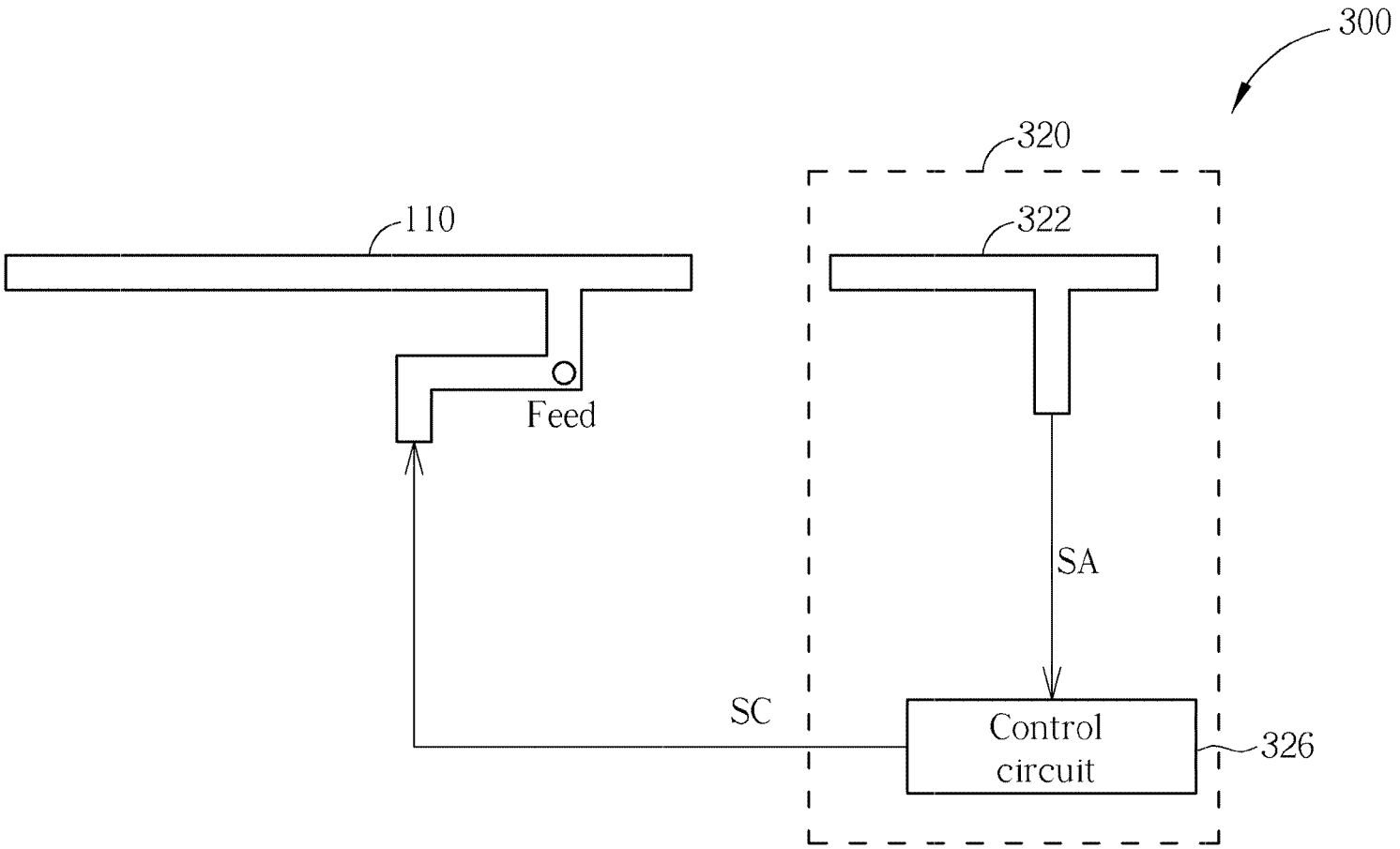
FIG. 3 is a schematic diagram of a configuration of an antenna component and a sensing component of an antenna apparatus according to a second embodiment of the present invention.
Figure 4:
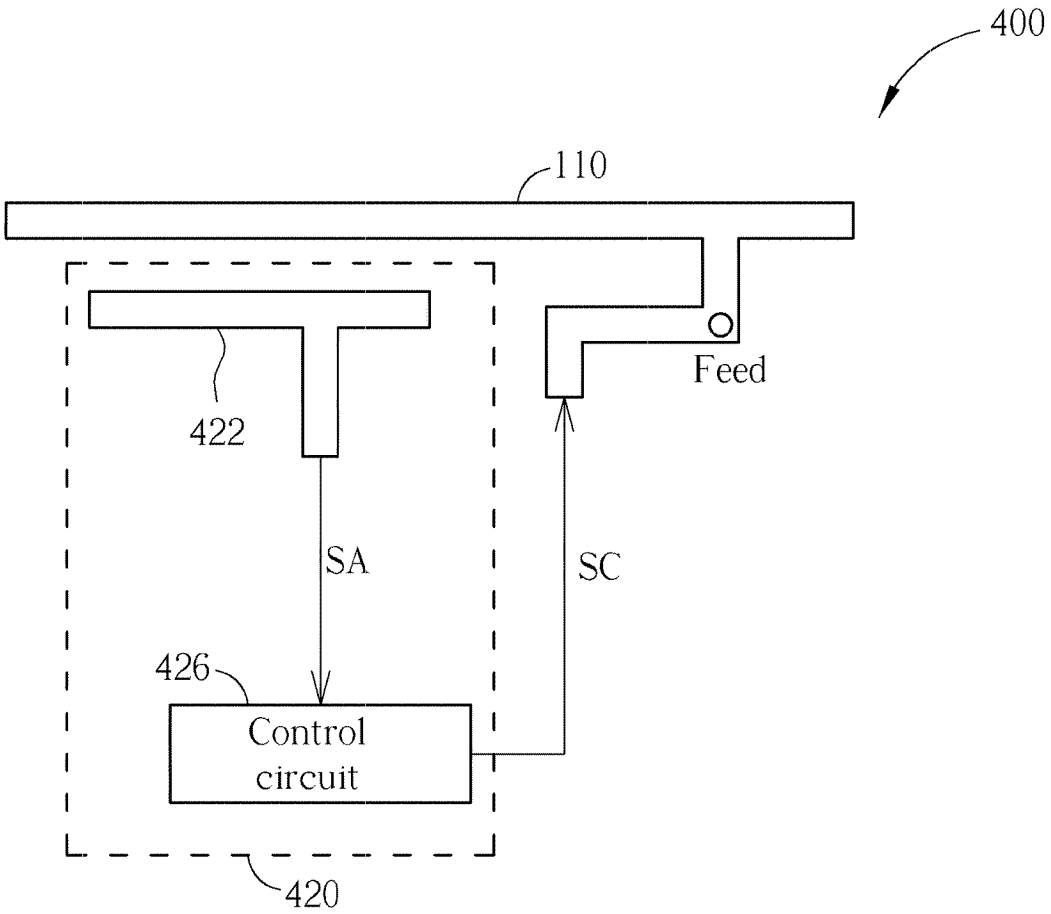
FIG. 4 is a schematic diagram of a configuration of an antenna component and a sensing component of an antenna apparatus according to a third embodiment of the present invention.

Please refer to FIG. 2 to FIG. 4. FIG. 2 is a schematic diagram of a configuration of an antenna component and a sensing component of an antenna apparatus according to a first embodiment of the present invention, FIG. 3 is a schematic diagram of a configuration of an antenna component and a sensing component of an antenna apparatus according to a second embodiment of the present invention, and FIG. 4 is a schematic diagram of a configuration of an antenna component and a sensing component of an antenna apparatus according to a third embodiment of the present invention. The antenna apparatus 200 includes the aforementioned antenna component 110 and a sensing device 220, wherein the sensing device 220 includes a sensing component 222 and a control circuit 226. The antenna apparatus 300 includes the aforementioned antenna component 110 and a sensing device 320, wherein the sensing device 320 includes a sensing component 222 and a control circuit 326. Operations of the antenna apparatus 200/300/400 and the antenna apparatus 100 are almost the same, and the main difference is shapes and relative positions of the antenna component 110 and the sensing component 222/222. Hence, the second mode generated due to coupling would be different. Those skilled in the art should readily understand operations of other circuit elements shown in FIG. 2 to FIG. 4 after reading the above paragraphs directed to circuit elements shown in FIG. 1, further description is omitted here for brevity.

Figure 5:
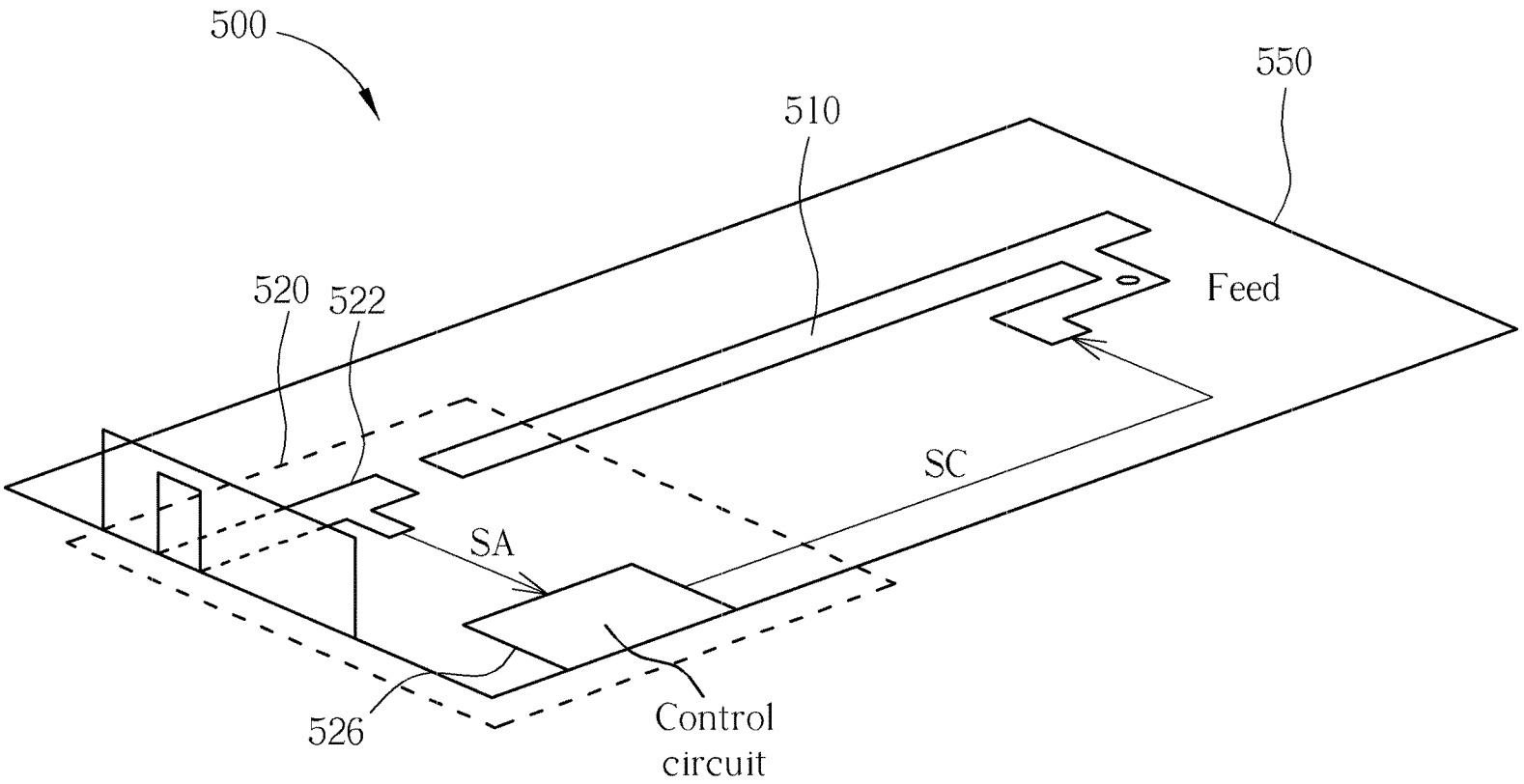
FIG. 5 is a schematic diagram of an antenna apparatus according to a fourth embodiment of the present invention.

Besides, please note that, the antenna component 110 and the sensing component 122 are not required to be disposed on the same plane. Please refer to FIG. 5, which is a schematic diagram of a configuration of an antenna component and a sensing component of an antenna apparatus according to a fourth embodiment of the present invention. The antenna apparatus 500 includes, but not limited to, an antenna component 510 and a sensing device 520, wherein the sensing device 520 includes a sensing component 522 and a control circuit 526. Operations of the antenna apparatus 500 and that of the antenna apparatus 100 are almost the same, and the main difference is that the antenna component 510 and the sensing component 522 are disposed on a housing 450 of the handheld electronic device (i.e., a three-dimensional structure of each of the antenna component 510 and the sensing component 522 may be determined according to a shape of the housing 550). In this way, the structure and length of the antenna component 510 and sensing component 522 may be extended by means of the housing 550, thus defining the frequency band of the second mode. To put it another way, modification of structure and/or length of the antenna component 510 and sensing component 522 may change the setting of the frequency band of the second mode. Those skilled in the art should readily understand operations of other circuit elements shown in FIG. 5 after reading above paragraphs directed to circuit elements shown in FIG. 1, further description is omitted here for brevity.

To sum up, the present invention provides an antenna apparatus and related signal processing device for adjusting output power according to a sensing signal by utilizing a SAR sensing FPC as an antenna. In this way, circuit areas required by a SAR sensing device may be effectively reduced, and the accuracy of SAR detection near the antenna is improved. This also provides a solution more compliant with user's habit, and significantly lowers the possibility of exposing the human body to the hazardous electromagnetic environment.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna apparatus, comprising:

a first antenna component, having at least one first frequency resonance mode; and a first sensing antenna component, being a component of a sensing device, wherein the first sensing antenna component is coupled to the first antenna component;

wherein impedance viewed by the first sensing antenna component looking into a control circuit coupled between the first antenna component and the first sensing antenna component is substantially zero, thereby enabling the first sensing antenna component to act as a second antenna component having a second frequency resonance mode for receiving a wireless signal, and the control circuit is coupled to the first antenna component and the first sensing antenna component at the same time.

2. The antenna apparatus of claim 1, wherein the sensing device is for detecting whether a human body approaches.

3. The antenna apparatus of claim 2, being disposed in a handheld electronic device.

4. The antenna apparatus of claim 1, wherein the first antenna component is capable of acting as a second sensing antenna component to detect whether a human body approaches.

5. A signal processing device, comprising:

a first antenna component, having at least one first frequency resonance mode; and a first sensing device, comprising:

a first sensing antenna component, for generating a sensing signal, wherein the first sensing antenna component is coupled to the first antenna component; and a control circuit, coupled to the first antenna component and the first sensing antenna component, for generating a control signal according to the sensing signal generated from the first sensing antenna component, to control output power of the first antenna component, wherein the control circuit is coupled to the first antenna component and the first sensing antenna component at the same time;

wherein impedance viewed by the first sensing antenna component looking into the control circuit is low, zero or near zero, thereby enabling the first sensing antenna component to act as a second antenna component having a second frequency resonance mode for receiving a wireless signal.

6. The signal processing device of claim 5, wherein the first sensing antenna component is coupled to ground through the control circuit.

7. The signal processing device of claim 5, wherein the sensing device is for detecting whether a human body approaches.

8. The signal processing device of claim 5, being disposed in a handheld electronic device.

9. The signal processing device of claim 5, wherein the first antenna component is capable of acting as a second sensing antenna component to detect whether a human body approaches.

* * * * *